US009115942B2

(12) United States Patent
Woodman

(10) Patent No.: US 9,115,942 B2
(45) Date of Patent: Aug. 25, 2015

(54) SYSTEM AND METHOD FOR BREAKING AND COCKING A SINGLE SHOT FIREARM

(71) Applicant: Woodman Arms Inc, Fremont, NH (US)

(72) Inventor: Mark W. Woodman, Nottingham, NH (US)

(73) Assignee: Woodman Arms Inc., Fremont, NH (US)

( * ) Notice: Subject to any disclaimer, the term of this patent is extended or adjusted under 35 U.S.C. 154(b) by 0 days.

(21) Appl. No.: 14/267,949

(22) Filed: May 2, 2014

(65) Prior Publication Data

US 2014/0325887 A1 Nov. 6, 2014

Related U.S. Application Data

(60) Provisional application No. 61/818,585, filed on May 2, 2013.

(51) Int. Cl.
*F41A 3/58* (2006.01)
*F41A 19/14* (2006.01)

(52) U.S. Cl.
CPC .. *F41A 3/58* (2013.01); *F41A 19/14* (2013.01)

(58) Field of Classification Search
USPC ..... 42/69.01–69.03, 43, 45, 75.02, 75.04
See application file for complete search history.

(56) References Cited

U.S. PATENT DOCUMENTS

| | | | | | |
|---|---|---|---|---|---|
| 2,765,561 | A * | 10/1956 | Morris | 42/69.01 |
| 2,881,547 | A * | 4/1959 | Butler | 42/16 |
| 3,276,158 | A * | 10/1966 | Johnston | 42/41 |
| 3,738,042 | A * | 6/1973 | Ruger et al. | 42/66 |
| 4,052,926 | A * | 10/1977 | Tollinger | 89/1.4 |
| 4,095,363 | A * | 6/1978 | Riedl | 42/23 |
| 4,103,586 | A * | 8/1978 | Tollinger | 89/144 |
| 4,128,956 | A * | 12/1978 | Foote | 42/23 |
| 4,299,046 | A * | 11/1981 | Atchisson | 42/75.04 |
| 4,310,981 | A * | 1/1982 | Waddell | 42/42.01 |
| 4,648,190 | A * | 3/1987 | Allen | 42/23 |
| 4,879,827 | A * | 11/1989 | Gentry | 42/23 |
| 4,964,232 | A * | 10/1990 | Mainland et al. | 42/44 |
| 5,233,775 | A * | 8/1993 | Dieckmann | 42/43 |
| 5,349,773 | A * | 9/1994 | Sprangers | 42/42.02 |
| 5,465,519 | A * | 11/1995 | Blanck | 42/70.11 |
| 5,467,549 | A * | 11/1995 | Rowlands et al. | 42/42.03 |
| 5,469,649 | A * | 11/1995 | Rowlands et al. | 42/43 |
| 5,682,699 | A * | 11/1997 | Gentry | 42/23 |
| 5,758,444 | A * | 6/1998 | Ruger et al. | 42/16 |
| 6,604,311 | B1 * | 8/2003 | Laney et al. | 42/51 |
| 6,760,991 | B1 * | 7/2004 | Gentry | 42/23 |
| 2004/0103575 | A1 * | 6/2004 | Rousseau et al. | 42/75.02 |
| 2009/0077853 | A1 * | 3/2009 | Storch | 42/65 |
| 2009/0199450 | A1 * | 8/2009 | Storch | 42/66 |
| 2010/0229446 | A1 * | 9/2010 | Ibarguren | 42/51 |
| 2013/0104436 | A1 * | 5/2013 | Heizer | 42/69.01 |

* cited by examiner

*Primary Examiner* — Michael David
(74) *Attorney, Agent, or Firm* — Devine, Millimet & Branch, PA; Paul C. Remus

(57) ABSTRACT

A system and method for breaking and cocking a single shot firearm by moving a piece of the firearm's trigger guard.

3 Claims, 6 Drawing Sheets

SYSTEM AND METHOD FOR BREAKING AND COCKING A SINGLE SHOT FIREARM

CROSS-REFERENCE TO RELATED APPLICATIONS

The present application claims the benefit of Provisional Patent Application Ser. No. 61/818,585 filed May 2, 2013, which is incorporated herein by reference.

FIELD OF THE INVENTION

The present invention relates to single shot firearms. More particularly, it relates to a system and method for breaking and cocking a single shot firearm.

BACKGROUND OF THE INVENTION

Many single shot firearms have a mechanism to break, or open, the firearm for loading. This mechanism allows the barrel assembly to pivot around a pivot joint perpendicular to the length of the barrel to expose the breach of the barrel assembly. Loading may then comprise either inserting a cartridge into the breach or, in the case of a muzzle loading firearm, inserting a primer into the breach.

Many single shot firearms have one mechanism to break the firearm and another separate mechanism to cock the hammer of the firearm. The present invention has one mechanism to do both.

SUMMARY OF THE INVENTION

The present invention is as system and method for breaking, and cocking the hammer of, a single shot firearm. After the firearm is broken, it can be loaded. It should be noted that "loading" is defined herein to include both inserting a cartridge in the breach of a firearm and inserting a primer in the breach of a firearm in which propellant is added through its muzzle.

The system and method of the present invention have a trigger guard divided into a moveable front piece and at back piece. The front piece has three functions. First, the front piece is part of a traditional trigger guard that limits access to the firearm's trigger. Second, the front piece can be moved to the rear, toward the stock of the firearm, so that the user of the firearm can break the firearm's action. When the action is broken, a used cartridge or primer can be extracted and a new one inserted into the breach of the firearm. Third, moving the front piece to the rear simultaneously cocks the firearm so that it is ready to fire when it is loaded and the action is closed.

These aspects of the invention are not meant to be exclusive and other features, aspects, and advantages of the present invention will be readily apparent to those of ordinary skill in the art when read conjunction with the following description, appended claims, and accompanying drawings.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF EMBODIMENTS OF THE INVENTION

Figure 1:
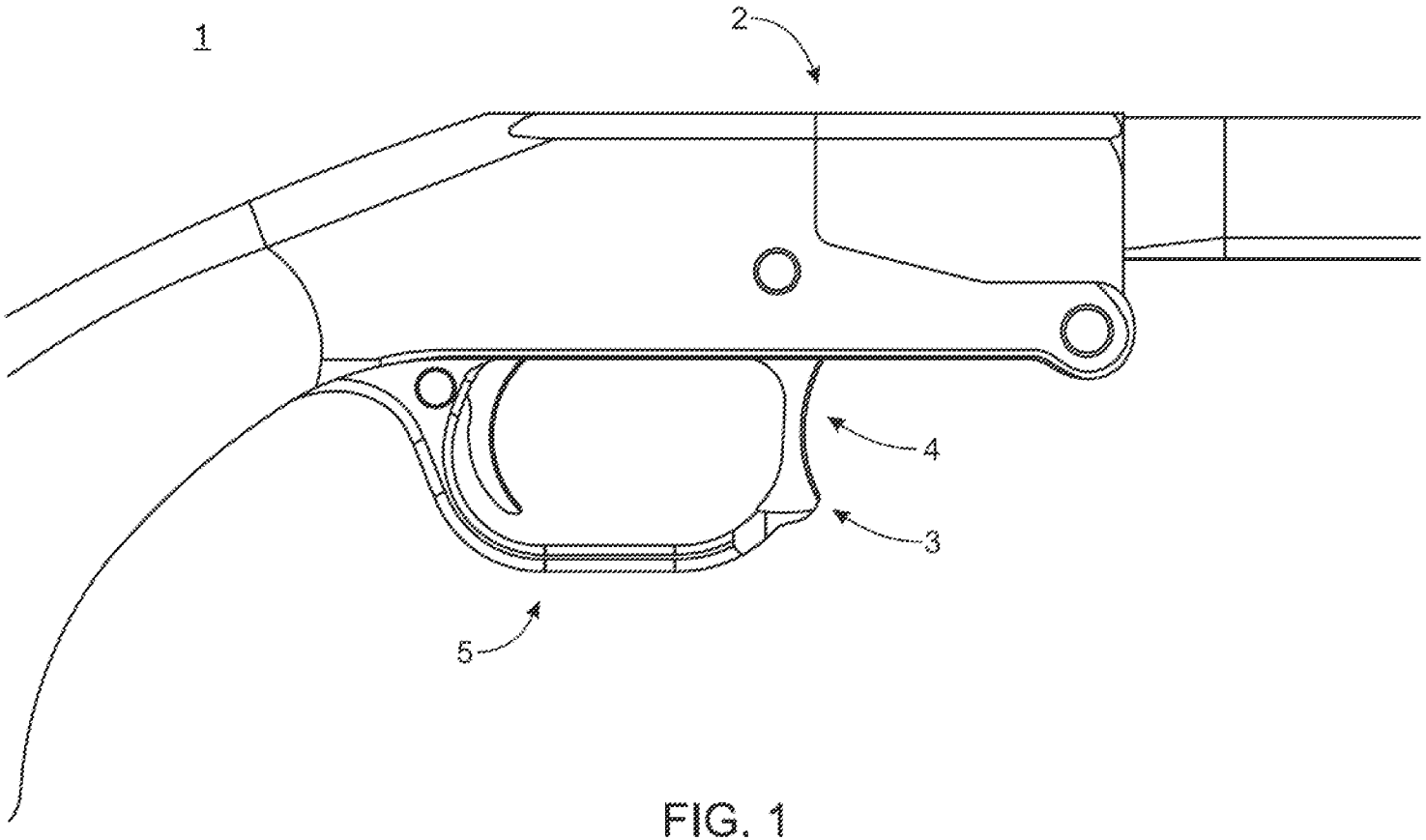
FIG. 1 is a side view of a firearm having an embodiment of the present invention wherein the action is closed.

The present invention is a system and method for breaking, and cocking the hammer of, a single shot firearm. FIG. 1 is an exterior side view of a single shot firearm 1 in which the action 2, which breaks to load the firearm, is closed. The trigger guard 3 is comprised of a pivotally moveable front piece 4 and a back piece 5.

Figure 2:
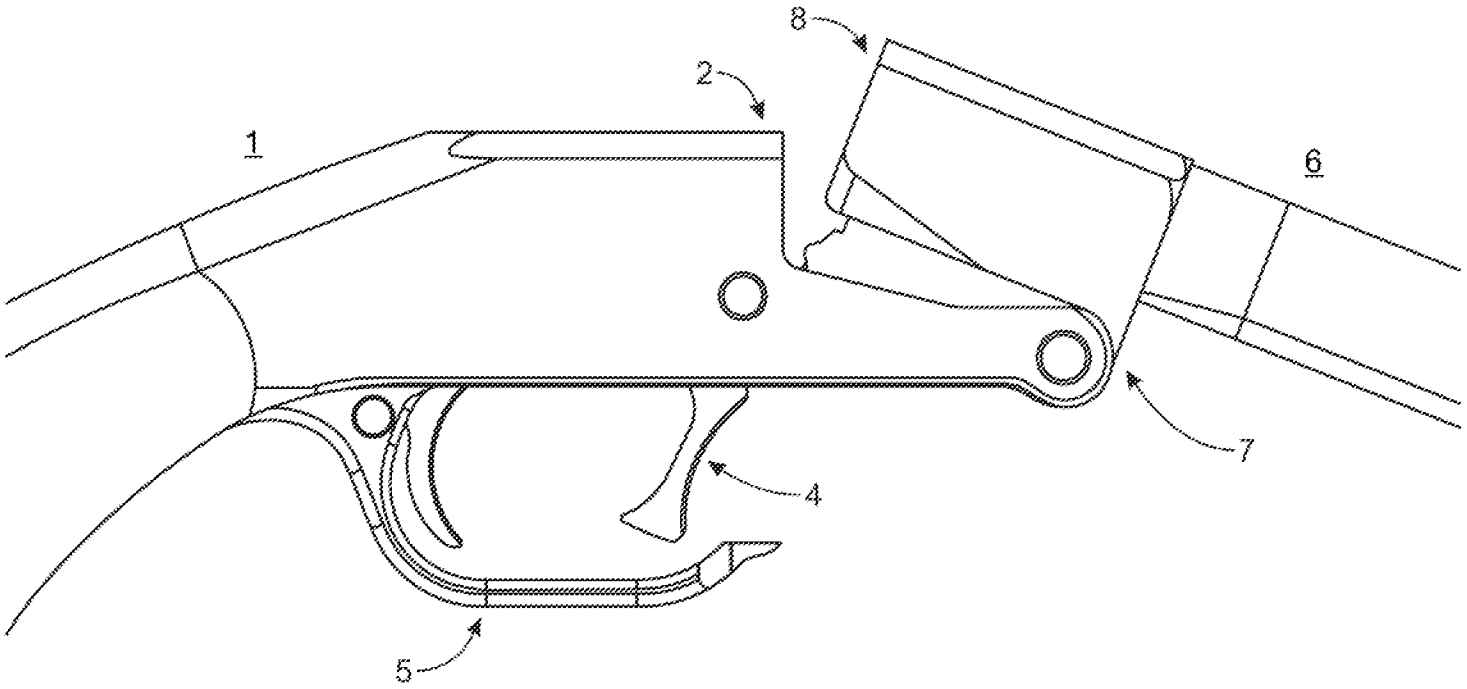
FIG. 2 is a side view of a firearm having an embodiment of the present invention wherein the action is broken.

FIG. 2 is an exterior side view of the same firearm 1, in which the front piece 4 of the trigger guard 3 is moved to a rear position, toward the stock of the firearm, and the action 2 is broken, or opened, to load the firearm. In other words, the barrel assembly 6 of the firearm pivots about a pivot point 7 such that the breach 8 is accessible for loading. The loading may consist either of inserting a cartridge into the breach 8 or inserting a primer into the breach 8 if the firearm is one in which propellant is added through the muzzle (not shown) of the barrel assembly 6.

Figure 3:
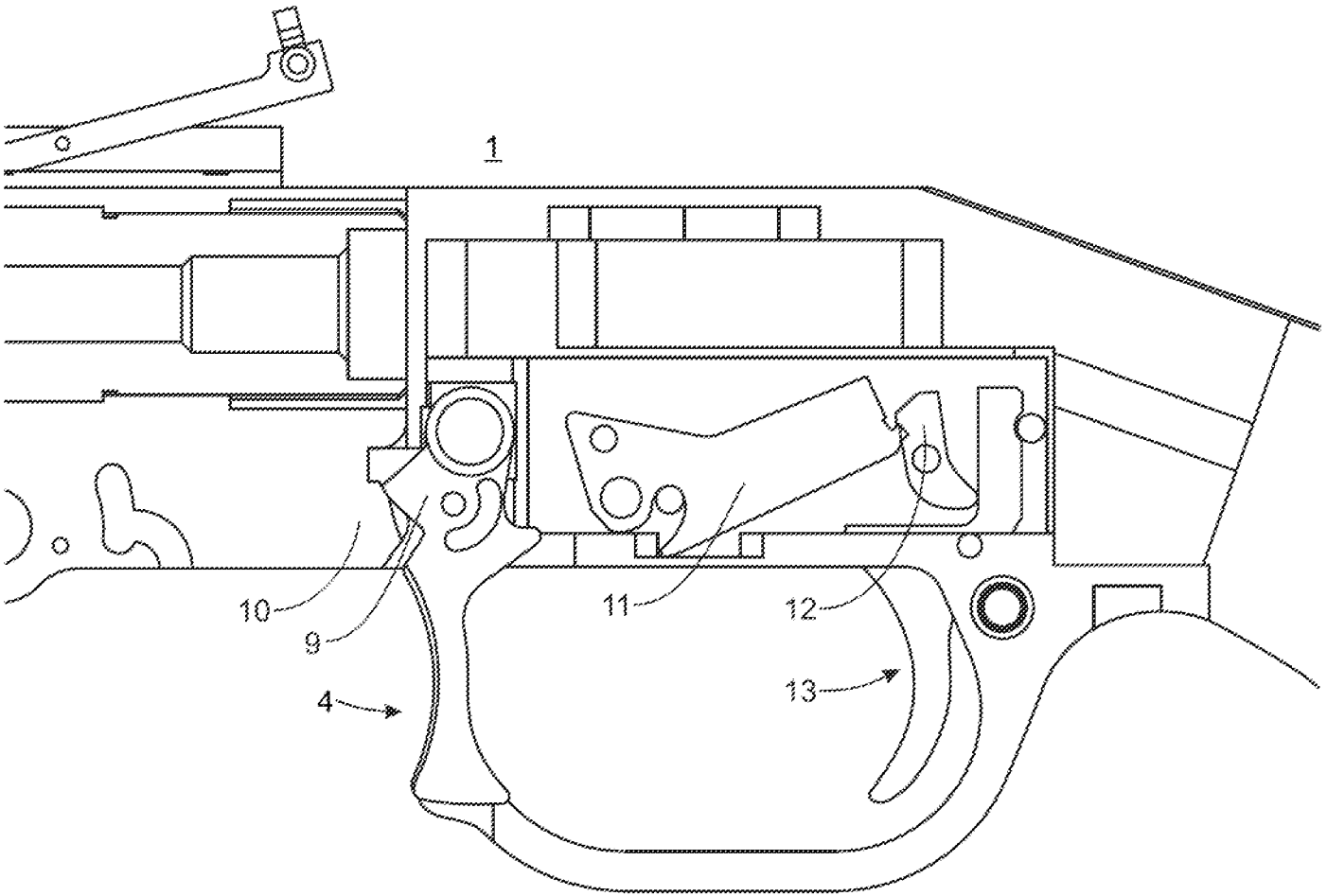
FIG. 3 is a cut-away view of a firearm having an embodiment of the present invention that is cocked and ready to fire.

FIG. 3 is as cut-away view of the firearm 1 with an embodiment of the system and method of the present invention. The front piece 4 of the trigger guard is pivoted to a forward position, toward the muzzle of the firearm. This causes a cam 9 on the front piece 4 to engage a protrusion 10 on the barrel assembly 6 of the firearm and hold the action closed. The hammer 11, which is spring-loaded, is cocked and held in position by a sear 12. When the trigger 13 is pulled, the sear 12 is pivoted and the hammer 11 is released so that the firearm fires.

Figure 4:
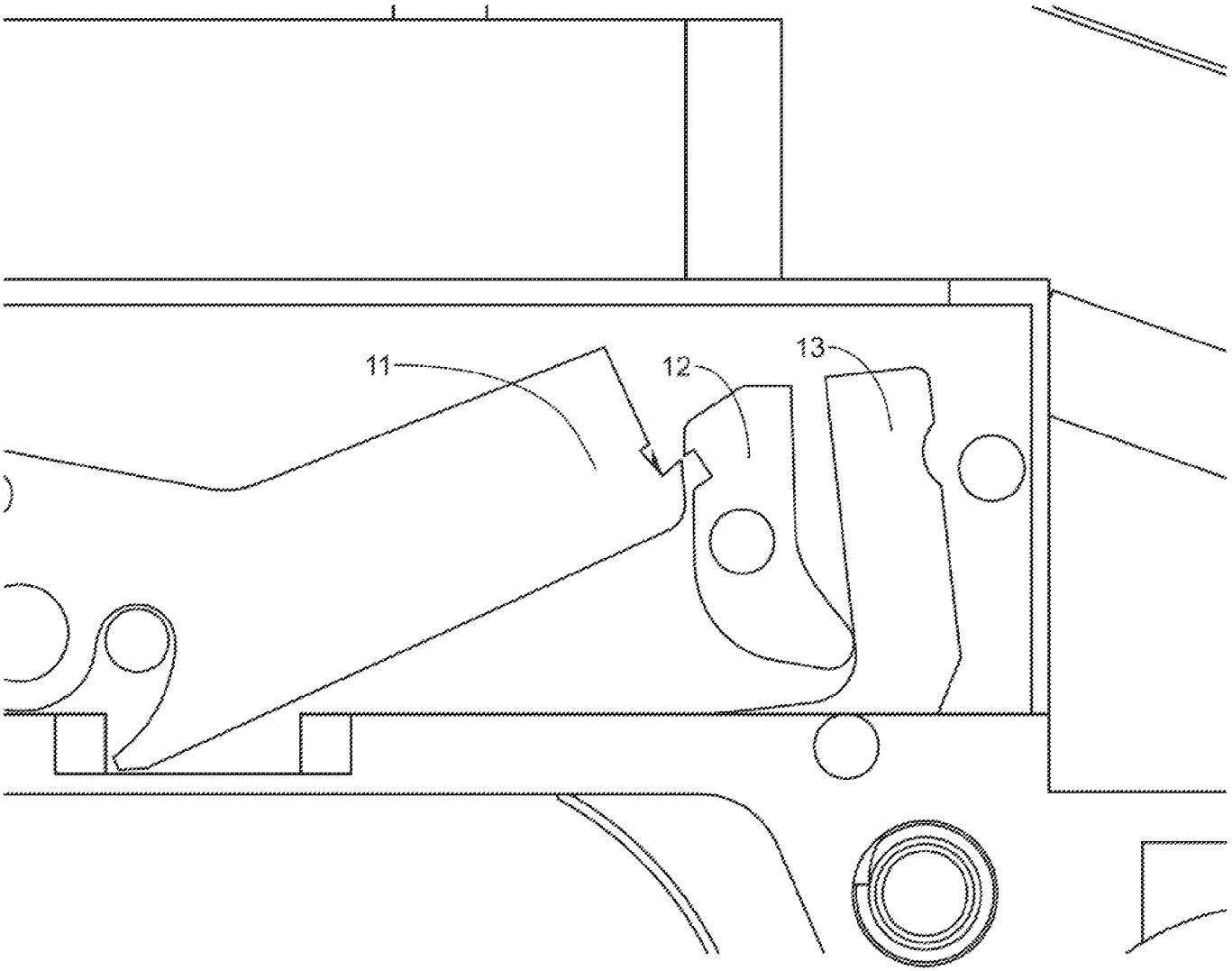
FIG. 4 is a cut-away close-up view of a firearm having an embodiment of the present invention that is being fired.
Figure 5:
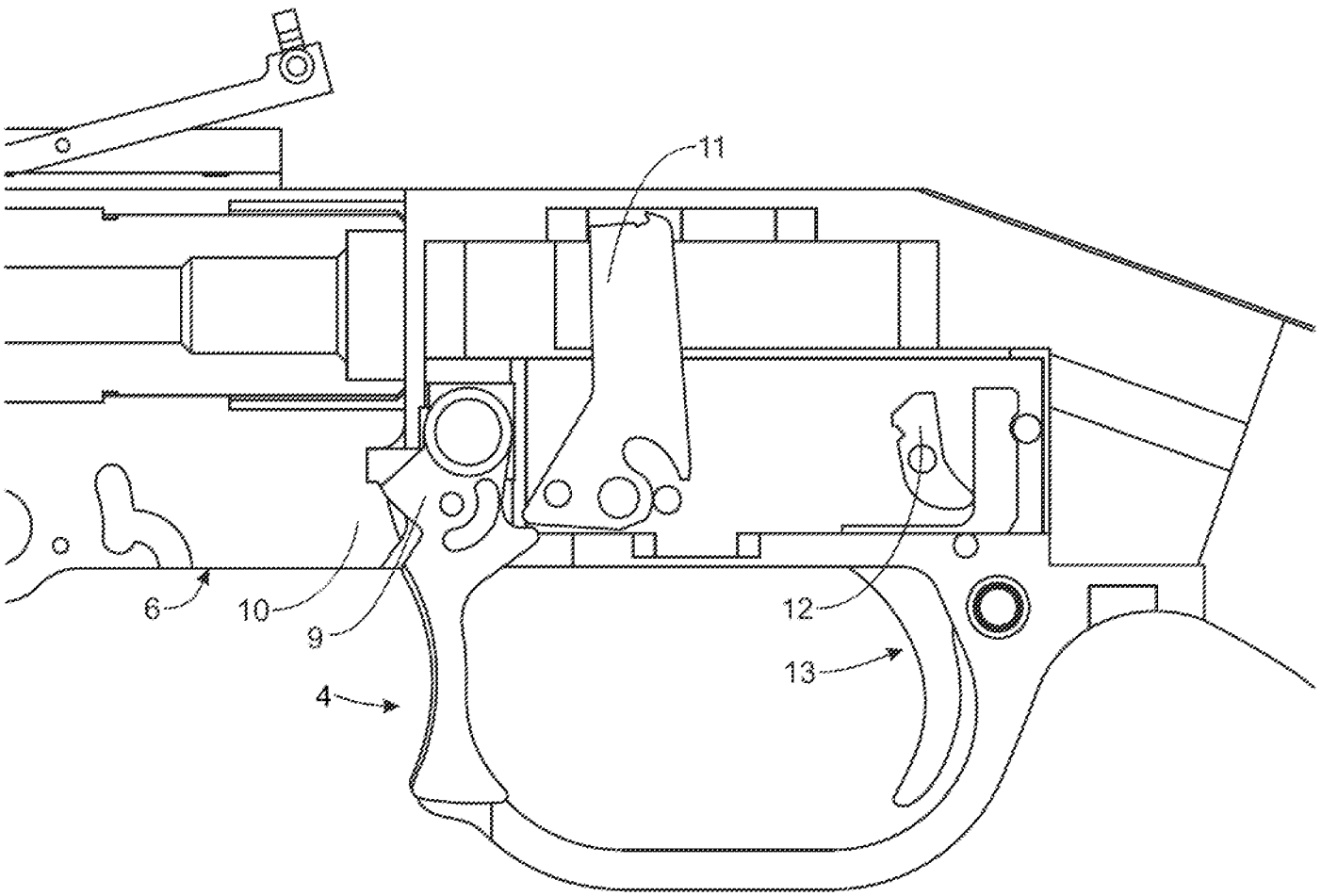
FIG. 5 is a cut-away view of a firearm having an embodiment of the present invention that has been fired.

FIG. 4 is a close-up view showing the trigger 13 being pulled so that the sear 12 is pivoted. This releases the hammer 11 so that the firearm fires. FIG. 5 shows the hammer 11 after the firearm is fired. It also shows the from piece 4 of the trigger guard in the forward position so that the cam 9 on the front piece 4 engages the protrusion 10 on the barrel assembly 6.

Figure 6:
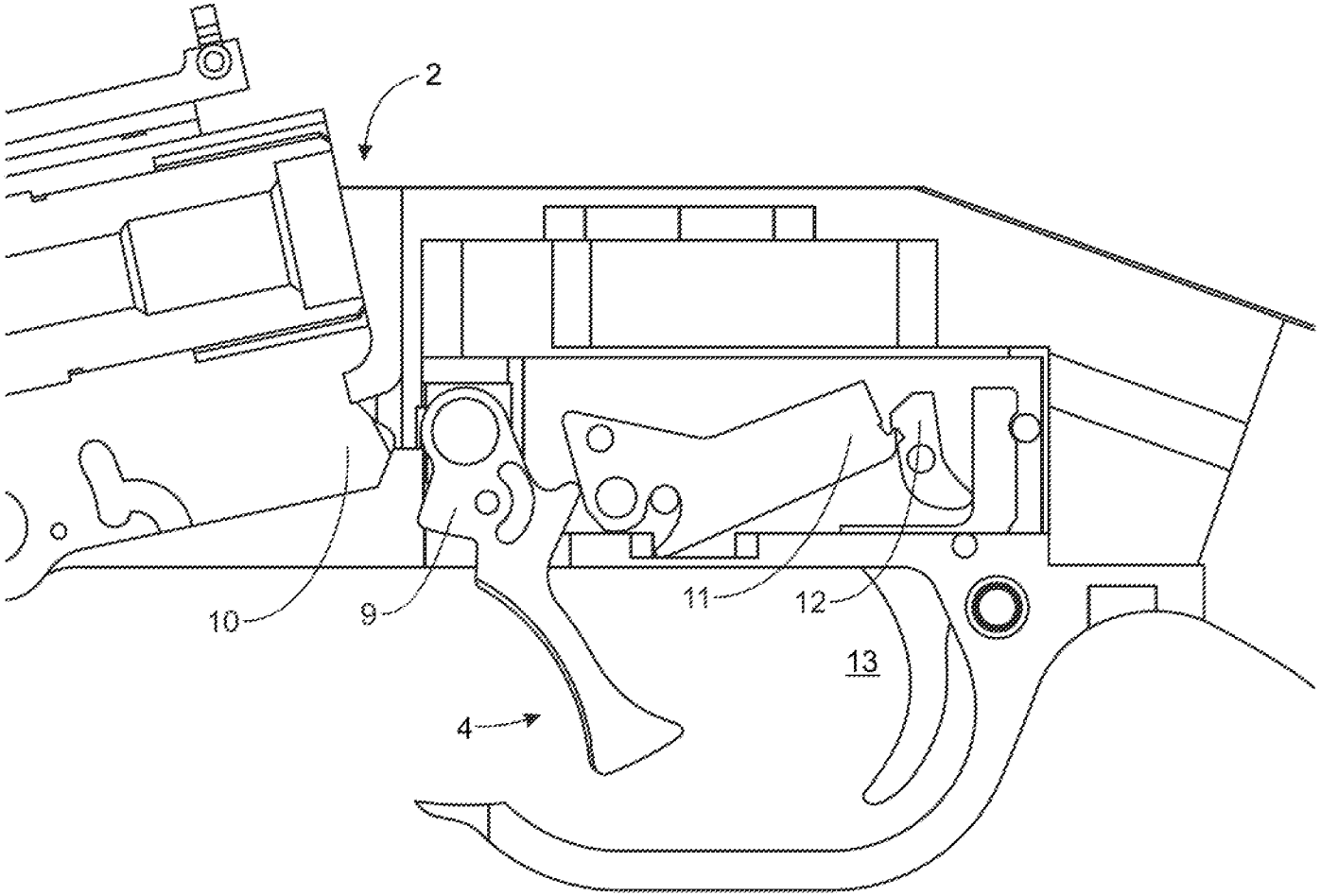
FIG. 6 is a cut-away view of a firearm having an embodiment of the present invention that is broken and cocked.

As shown in FIG. 6, when the front piece 4 of the trigger guard is moved to the rear position, it causes the cam 9 on the front piece 4 to disengage the protrusion 10 on the barrel assembly 6, thereby allowing the breaking of the action 2. Simultaneously, the rearward movement of the front piece 4 also causes the hammer 11 to pivot and engage the sear 12, which holds the hammer 11 in place. When the trigger 13 is subsequently pulled, the hammer 11 is released, as shown in FIG. 4.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A system system for breaking and cocking the action of a single shot firearm, comprising an action with a trigger guard having a front piece and a back piece, such that the front piece is pivotally moveable from a front position to a rear position;

a barrel assembly having a breech and a barrel with a length and a protrusion;

a cam on the front piece such that the earn engages the protrusion when the front piece is in the front position thereby holding the action closed and disengages the protrusion when the front piece is pivoted to the rear position thereby allowing the barrel assembly to pivot around a pivot joint perpendicular to the length of the barrel to expose the breech of the barrel assembly for loading;

a hammer that is caused to be pivoted to a cocked position when the front piece is pivoted to the rear position;

a sear to hold the hammer in the cocked position.

2. A system system for breaking the action of a single shot firearm, comprising an action with a trigger guard having a front piece and a back piece, such that the front piece is pivotally moveable from a front position to a rear position;

a barrel assembly having a breech and a barrel with a length and a protrusion;

a cam on the front piece such that the cam engages the protrusion when the from piece is in the front position thereby holding the action closed and disengages the protrusion when the front piece is pivoted to the rear position thereby allowing the barrel assembly to pivot around a pivot joint perpendicular to the length of the barrel to expose the breech of the barrel assembly for loading.

3. A method for breaking and cocking a single shot firearm, comprising moving a front piece of a trigger guard having a front piece and a back piece pivotally from a front position to a rear position;

including a barrel assembly having a breech and a barrel with a length and a protrusion;

causing a cam on the front piece that engages a protrusion on a barrel assembly when the front piece is in the front position thereby holding the action closed to disengage the protrusion when the front piece is pivoted to the rear position thereby allowing the barrel assembly to pivot around a pivot joint perpendicular to the length of the barrel to expose the breech of the barrel assembly for loading;

causing a hammer to be pivoted to a cocked position when the front piece is pivoted to the rear position;

causing a sear to hold the hammer in the cocked position.

* * * * *